United States Patent [19]

Berman

[11] Patent Number: 4,638,409

[45] Date of Patent: Jan. 20, 1987

[54] SWITCHING METHOD AND DEVICE USING MOVABLE BATTERY

[76] Inventor: Marc Berman, 10 Ashford St., Allston, Mass. 02134

[21] Appl. No.: 796,165

[22] Filed: Nov. 8, 1985

[51] Int. Cl.[4] ..... A44C 9/00

[52] U.S. Cl. ..... 362/104; 362/103; 368/204

[58] Field of Search ..... 362/103, 104, 8, 9; 174/53; 320/33, 34; 368/203, 204, 205; 339/1 R, 2 R, 2 A, 5 S, 8 R, 9 R, 34; 63/1 R, 12, 13

[56] References Cited

U.S. PATENT DOCUMENTS

| | | | |
|---|---|---|---|
| 2,920,543 | 1/1960 | Azarraga | 362/8 |
| 3,068,444 | 12/1962 | Kelchner | 339/9 R |
| 3,441,765 | 4/1969 | Mayburn et al. | 339/5 S |
| 3,544,781 | 12/1970 | Schmidt | 362/8 |
| 3,586,413 | 3/1969 | Adams | 339/2 R |
| 3,622,684 | 10/1970 | Press | 339/34 |
| 3,747,327 | 7/1973 | Uchiyama | 368/204 |
| 3,752,049 | 8/1973 | Rentschlar | 362/8 |
| 3,911,663 | 10/1975 | Kern et al. | 368/204 |
| 4,222,623 | 9/1980 | Hultborg | 339/34 |
| 4,440,504 | 4/1984 | Miyazaki | 368/204 |
| 4,473,869 | 9/1984 | De Widt | 339/2 A |
| 4,551,028 | 11/1985 | Rawson et al. | 368/204 |

*Primary Examiner*—Raymond A. Nelli
*Attorney, Agent, or Firm*—Donald W. Meeker

[57] ABSTRACT

A non-conductive housing retains a small battery slidably within a recess in the housing. An electrically conductive clip or plate holds the battery within the recess. In an "off" position the battery contacts the non-conductive housing. Moved to the "on" position the battery contacts a thin conductive layer bonded to the housing, thereby completing and adding power to a circuit connected with the clip and an electrical or electronic element or device to be powered. Lighted or sounding jewelry or other small items containing an electrical element are applications. Additional positions of the movable power source may control other circuits causing other electrical and electronic effects such as flashing or sequential lights.

20 Claims, 12 Drawing Figures

SWITCHING METHOD AND DEVICE USING MOVABLE BATTERY

BACKGROUND OF THE INVENTION

1. Technical Field

The present invention relates to electrical switching methods and devices and in particular to a activating control switch which employs a movable battery as the switching means for use in limited space situations such as on elecrical or electronic jewelry.

2. Background Art

Most electrical devices utilize a switching means which involves some mechanical, electrical, electronic or other means for turning the electrical device on and off, requiring further space, expense and potential failure problems in addition to the working element and the power source.

In elecrical devices usually the first element to fail is the switching means thereby rendering the entire device useless for want of a means to activate a perfectly good working element and power source.

Jewelry typically relies on external light sources to reveal its visual appeal. Due to the small size of jewelry it has usually been difficult to provide any electrical elements on jewelry without adding a substantial amount of weight to create discomfort in having to bear the weight on the body. Normal electrical circuits employing the electrical element, the power source and the switching means in addition to the conductors necessary to connect them together become too cumbersome for normal longterm use and lose the elegant attractive appeal of delicate jewelry.

DISCLOSURE OF INVENTION

A small battery or other portable power source is moved to various positions into and out of contact with one or more circuits powering an electrical or electronic elements, thereby activating and deactivating the elements, and thereby providing a simple, problem-free switching means which takes up no extra space lending itself to uses with limited space, such as electrical jewelry.

Since there are no mechanical or electronic switching mechanisms involved there is nothing than can fail, so that reliability is provided in a switching means.

Using miniature batteries or other small power sources as moving switches for electrical or electronic elements with no additional switching means creates a light-weight and elegantly streamlined electrical or electronic element suitable for use in jewelry and other applications where space and weight are a concern.

Coin size three volt lithium battery cells provide high current and long life in a size and shape which are appropriate for sliding the battery within a small space.

BRIEF DESCRIPTION OF THE DRAWINGS

These and other details and advantages of my invention will be described in connection with the accompanying drawings, which are furnished merely by way of illustration and not in limitation of the invention, and in which drawings.

BEST MODE FOR CARRYING OUT THE INVENTION

Figure 1:
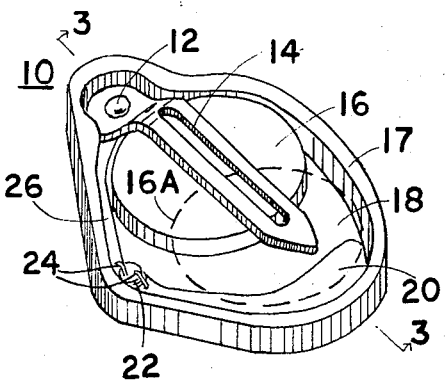
FIG. 1 is a perspective view of the basic movable battery switch mechanism for activating an electrical element.
Figure 3:
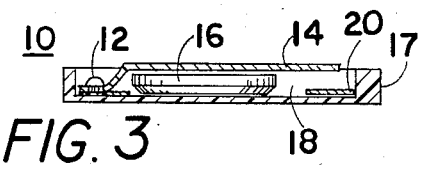
FIG. 3 is a cross-sectional view of the movable battery switching means with the battery in the "off" position taken through 3—3 of FIG. 1.
Figure 4:
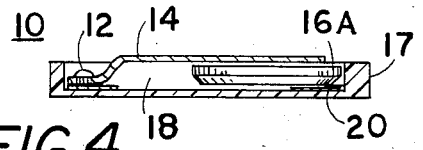
FIG. 4 is the same cross-sectional view of the movable battery switching means with the battery in the "on" position.

In the FIGS. 1, 3 and 4 the basic movable battery switching means 10 of the invention comprises a rigid non-conductive housing 17 having an elongated recess 18 within which a small battery 16 may be manually shifted between an "off" position of the battery 16, indicated by solid lines, and an "on" position of the battery 16A, indicated by dashed lines. A retaining means of electrically conductive material, such as a metal spring clip 14, secures the battery slidably within the recess, wherein the walls of the recess retain the battery in all lateral directions.

A narrow conductive strip 26 fabricated of metal such as copper or printed as a circuit (such as conductive ink on a substrate) is bonded to the back of the recess around one side of the recess immediately adjacent to the side wall of the recess. The conductive strip electrically connects the clip 14 to a larger conductive area 20 at a bottom end of the recess, thereby forming an electric circuit with an element 22 which is activated by an electric current. Contacts 24 such as wires are bonded or soldered to the thin conductive strip 26. When the battery 16A is slid into the "on" position is indicated in FIG. 4 (also indicated by dashed lines in FIG. 1) the battery then completes the electric circuit and adds the power at the same time to activate the electrical element 22, which may be a light, such as a light emitting diode or a light emitting a beam, a flashing device, sounding device or any other electrically powered element. The clip 14 may be secured by heat staked plastic 12, a rivet or other means creating tension on the clip against the battery.

Figure 2:
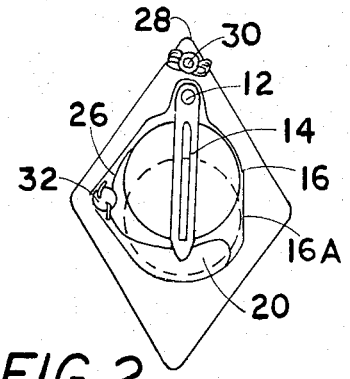
FIG. 2 is a back elevational view of the movable battery switch built into a lighted earring.
Figure 5:
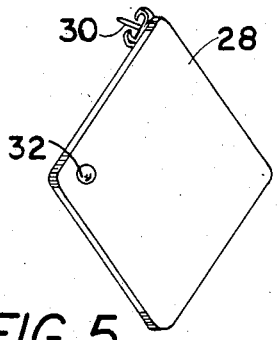
FIG. 5 is a perspective view of an earring employing the movable battery switching means to activate a light or alternately the same piece could serve as a tie tack.

In FIGS. 2 and 5 the movable battery switching means is applied to an earring 28 with a post 30 and conventional attaching means. The battery 16 powers a light emitting diode 32 which protrudes through the body of the earring to be brightly visible on the front side of the earring as seen in FIG. 5. The same piece of jewelry or another shape with a similar post could be used as a tie tack.

Figure 6:
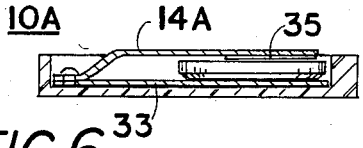
FIG. 6 is a similar cross-sectional view to that of FIGS. 3 and 4, but taken through an alternate embodiment of the body of the jewelry, wherein the body of the piece of jewelry is conductive and the clip is partially conductive.

In FIG. 6 an alternate embodiment comprises a body of the jewelry 28B having a conductive recess by coating the back wall of the recess with a conductive layer 33 formed of metal or printed circuit and a clip 14A having only a small portion 33 conductive to complete the circuit as required.

Figure 7:
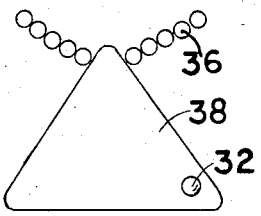
FIG. 7 is a front elevational view of a pendant for a necklace, bracelet or the like suspended by a chain employing the movable battery switching means to activate a light.

In FIG. 7 the movable battery switching means is mounted on the back (not visible) of a pendant 38 hung by a chain 36 or other means to be used as a bracelet or necklace with a light emitting diode 32 appearing on the face of the pendant.

Figure 8:
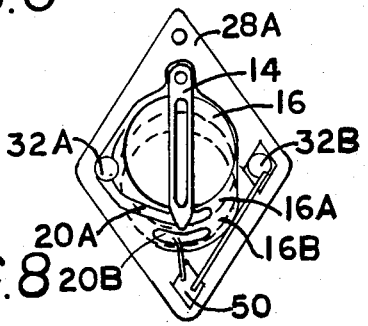
FIG. 8 is a back elevational view of an alternate embodiment of the jewelry having additional elements and circuits.

In FIG. 8 an alternate embodiment of the invention comprises a casing 28A having additional elements, such as an additional light emitting diode 32B positioned in an additional recess opposite to the other light emitting diode 32A. An additional circuit 50 may be positioned within another recess in the bottom back of the piece of jewelry. Additional positions of movement of the battery shown dashed at 16A and 16B may activate the lights normally in one position and operate the electronic circuit 50 for a function such as blinking in the second position of the battery.

Figure 9:
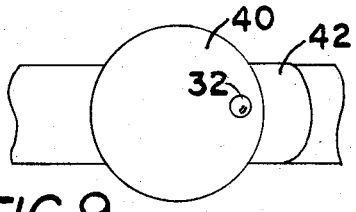
FIG. 9 is a front elevational view of a buckle for a belt or the like employing the movable battery switching means to activate a light.

In FIG. 9 the movable battery switching means is mounted on the back (not visible) of a belt buckle 40 conventionally attached to a belt 42 with a light emitting diode appearing on the front of the buckle.

Figure 10:
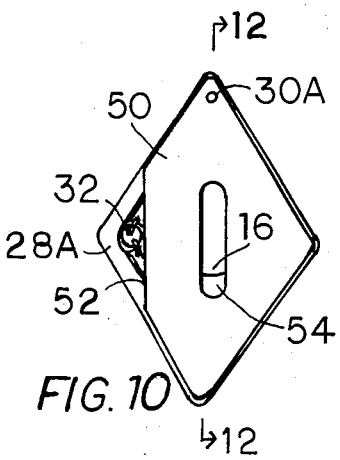
FIG. 10 is a back elevational view of an alternate embodiment of the jewelry having a slotted back plate covering the battery.
Figure 11:
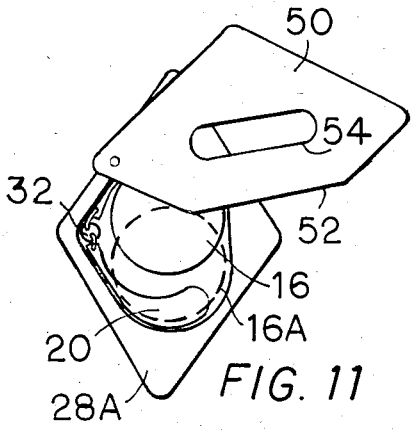
FIG. 11 is a back elevational view of the same alternate embodiment with the slotted plate rotated to uncover the battery.
Figure 12:
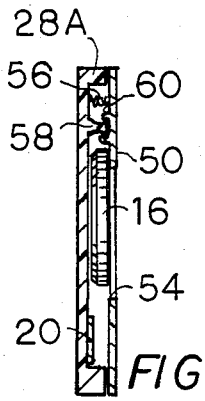
FIG. 12 is a cross-sectional view of the slotted plate embodiment taken through 12—12 of FIG. 10.

In FIGS. 10, 11 and 12 an alternate embodiment of the invention provides a pivoting conductive plate 50 over the back of the jewelry body 28A. A slot 54 in the back plate reveals the position of the battery 16 beneath the plate and permits movement of the battery through the slot to activate and deactivate the circuit illuminating the L.E.D. 32, which is exposed through a cut-away portion 52 of the backplate, which otherwise conforms to the shape of the jewelry. The back plate pivots, as in FIG. 11, to permit access to change the battery. The post 30A for attaching the jewelry as an earring is formed as an extension from the plate.

The back plate 50, in FIG. 12 is pivotally attached to the jewelry body 28A by a post 58 from the jewelry which fits rotatably within a snap-on socket 60 protruding from the back plate. A spring 56 forces the back plate into better contact with the battery 16 to complete a circuit with the plate, battery and contact 20 when the battery is down in the "on" position.

Although only a few possible applications of the movable battery switching means are illustrated it is understood that many other such applications exist which still fall within the realm of the invention as claimed for use in powering any electrical or electronic element or device, particularly where space or weight requirements are limited. Although all of the devices shown are preferrably fabricated of injection molded plastic, any non-conductive material may serve to house the movable battery switching means.

It is understood that the preceding description is given merely by way of illustration and not in limitation of the invention and that various modifications may be made thereto without departing from the spirit of the invention as claimed.

I claim:

1. A movable power source switching means for an electrically powered element or device, wherein the switching means comprises:

an electrically powered device;

a receiving means for an electrical power source, wherein the receiving means comprises a retaining means for slidably retaining the power source between at least a first and second position within the retaining means;

an electrical conductor connecting the power source receiving means to the electrically powered device, wherein the power source in the first position contacts the conductor to make a closed circuit between the power source and the electrically powered device thereby activating the electrically powered device, and wherein the power source in the second position breaks the circuit thereby deactivating the electrically powered device.

2. The invention of claim 1 wherein the power source comprises a compact disc-like battery.

3. The invention of claim 2 wherein the power source retaining means comprises an electrically conductive tensioned clip contacting the electrical conductor, which tensioned clip maintains the battery slidably against a flat surface having a first portion corresponding to the first position of the battery, which first portion is provided with a conductive means electrically connected to the conductor and a second portion, corresponding to the second position of the battery, which second portion is at least equal in area to a contacting portion of the battery and which second portion is electrically non-conductive, and which retaining means further comprises peripheral guides to maintain the battery within the limits of the two positions.

4. The invention of claim 3 wherein the electrically powered device comprises a piece of jewelry having an electrical or electronic element.

5. The invention of claim 4 wherein the electrical or electronic element comprises a light emitting diode.

6. The invention of claim 4 wherein the electrical or electronic element comprises a visible light beam producing means.

7. The invention of claim 4 wherein the electrical or electronic element comprises a sound producing means.

8. The invention of claim 4 wherein the electrical or electronic element comprises at least one lighted symbol.

9. The invention of claim 4 wherein the electrical or electronic element comprises a programmable electronic device.

10. The invention of claim 4 wherein the piece of jewelry comprises an earring.

11. The invention of claim 4 wherein the piece of jewelry comprises a pendant on a necklace.

12. The invention of claim 4 wherein the piece of jewelry comprises a component on a bracelet.

13. The invention of claim 4 wherein the piece of jewelry comprises a tie clip.

14. The invention of claim 3 wherein the conductive means in the first portion of the flat surface comprises a printed circuit.

15. The invention of claim 3 wherein the conductive means in the first portion of the flat surface comprises conductive self-adhesive foil.

16. The invention of claim 1 wherein the power source retaining means comprises a tensioned clip having a conductive portion corresponding to the first postion of the power source, wherein the conductive portion of the clip connects to the electrical conductor and a non-conductive portion at least equal in length to the length of the power source and the non-conductive portion of the clip corresponds to the second position of the power source, and wherein the receiving means comprises a flat surface in opposition to the clip and against which flat means the power source is slidably retained by the clip and wherein the flat surface comprises a conductor over both positions of the power source.

17. The invention of claim 2 wherein the power source retaining means comprises an electrically conductive plate substantially covering the receiving means wherein the conductive plate comprises an opening therethrough for viewing and altering the position of the battery and wherein the plate is pivotally attached to the retaining means.

18. A piece of jewelry having a movable power source which acts as a control switch for an electrical element on the piece of jewelry, wherein the piece of jewelry comprises:

a body portion shaped as desired externally, wherein the body comprises an electrically powered element and a battery receiving means movably retaining a battery to power the element, wherein the battery is free to move between at least a first and second position within the battery receiving means;

electrical conducting means within the battery receiving means, wherein the battery in a first position completes an electrical circuit between the battery, the conducting means and the element, thereby activating the element, and in the second position, the battery breaks the circuit thereby deactivating the element.

19. The invention of claim 18 wherein the battery receiving means further comprises an electrically conductive tensioned clip contacting the electrical conductor, which tensioned clip maintains the battery slidably against a flat surface having a first portion corresponding to the first position of the battery, which first portion is provided with a conductive means electrically connected to the conductor and a second portion, corresponding to the second position of the battery, which second portion is at least equal in area to a contacting portion of the battery and which second portion is electrically non-conductive, and which retaining means further comprises peripheral guides to maintain the battery within the limits of the two positions.

20. A method for controlling the electrical circuit between a power source and an electrical or electronic element wherein the power source itself is moved to multiple positions corresponding to control points, wherein in one position the power source forms part of a closed electrical circuit with an electrically powered device and a conductor between the power source and the electrically powered device to activate the electrically powered device, and in another position the power source is separated from the electric circuit to deactivate the electrically powered device, and in other positions the power source activates other circuits for various controlling functions.

* * * * *